US010969157B2

(12) United States Patent
Cheng et al.

(10) Patent No.: US 10,969,157 B2
(45) Date of Patent: Apr. 6, 2021

(54) REFRIGERATOR

(71) Applicant: QINGDAO HAIER JOINT STOCK CO., LTD., Qingdao (CN)

(72) Inventors: Xueli Cheng, Qingdao (CN); Bin Fei, Qingdao (CN); Yazhou Shang, Qingdao (CN); Dengqiang Li, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 106 days.

(21) Appl. No.: 16/488,225

(22) PCT Filed: Jun. 28, 2018

(86) PCT No.: PCT/CN2018/093278
§ 371 (c)(1),
(2) Date: Aug. 22, 2019

(87) PCT Pub. No.: WO2019/001499
PCT Pub. Date: Jan. 3, 2019

(65) Prior Publication Data

US 2019/0368800 A1 Dec. 5, 2019

(30) Foreign Application Priority Data

Jun. 29, 2017 (CN) ..... 201710517951.X

(51) Int. Cl.
*F25D 11/02* (2006.01)
*F25D 17/06* (2006.01)
(Continued)

(52) U.S. Cl.
CPC ..... *F25D 17/062* (2013.01); *F25D 11/02* (2013.01); *F25D 17/045* (2013.01);
(Continued)

(58) Field of Classification Search
CPC ..... F25D 17/045; F25D 2317/063; F25D 23/061; F25D 11/02; F25D 17/062;
(Continued)

(56) References Cited

U.S. PATENT DOCUMENTS 7,942,017 B2 * 5/2011 Lee ..... F25D 23/126 62/344
9,557,091 B1 * 1/2017 Zardo ..... F25D 17/065
(Continued)

FOREIGN PATENT DOCUMENTS

CN 1124056 A 6/1996
CN 106168427 A 11/2016
(Continued)

*Primary Examiner* — Filip Zec
(74) *Attorney, Agent, or Firm* — Cheng-Ju Chiang

(57) ABSTRACT

A refrigerator, comprising: a refrigerator body, an air duct assembly and a branched air supply apparatus; the air duct assembly has an accommodating cavity, air passages, and air supply ports opening forward; the air passages comprise a first air passage and a plurality of second air passages; the branched air supply apparatus is installed in the accommodating cavity and has a peripheral wall portion; the peripheral wall portion defines a plurality of air outlets, the plurality of air outlets comprising a first air outlet and a plurality of second air outlets; the first air passage is communicated with the first air outlet and a first storage space; each second air passage is communicated with one second air outlet and one or more air supply ports, and each of the second air outlets communicates with at least one second air passage.

8 Claims, 4 Drawing Sheets

(51) Int. Cl.
*F25D 17/04* (2006.01)
*F25D 23/06* (2006.01)
*F25D 25/02* (2006.01)

(52) U.S. Cl.
CPC ..... *F25D 23/061* (2013.01); *F25D 25/021* (2013.01); *F25D 25/025* (2013.01); *F25D 2317/063* (2013.01); *F25D 2317/067* (2013.01); *F25D 2317/068* (2013.01)

(58) Field of Classification Search
CPC ..... F25D 17/065; F25D 2317/067; F25D 2317/068; F25D 2317/0681; F25D 25/021; F25D 25/025
See application file for complete search history.

(56) References Cited

U.S. PATENT DOCUMENTS

| | | | | |
|---|---|---|---|---|
| 2018/0224187 | A1* | 8/2018 | Han | F25D 25/025 |
| 2018/0259239 | A1* | 9/2018 | Kim | F25D 23/069 |
| 2018/0274840 | A1* | 9/2018 | Fei | F25D 17/045 |

FOREIGN PATENT DOCUMENTS

| | | | |
|---|---|---|---|
| CN | 106225384 | A | 12/2016 |
| CN | 106679288 | A | 5/2017 |
| CN | 107356037 | A | 11/2017 |

* cited by examiner

REFRIGERATOR

The present application is a 35 U.S.C. § 371 National Phase conversion of International (PCT) Patent Application No. PCT/CN2018/093278, filed on Jun. 28, 2018, which claims the priority to the Chinese Patent Application No. 201710517951.X, filed on Jun. 29, 2017 and entitled "Refrigerator", which is incorporated herein by reference in its entirety. The PCT International Patent Application was filed and published in Chinese.

TECHNICAL FIELD

The present invention relates to the field of article storage by refrigerating and freezing, in particular to a refrigerator.

BACKGROUND

In recent years, with improvements in people's living standards and increases in the environmental awareness, the requirements on refrigerators are shifted from low-temperature refrigeration to freshness-keeping performance of the food. Therefore, air-cooled refrigerators gradually become popular. For the air-cooled refrigerator, the freshness-keeping performance of the food depends to a large extent on air circulation in an article storage compartment of the air-cooled refrigerator and temperature differences between respective sections of the refrigerator body. If the air circulation in the refrigerator body is reasonable, the smaller the temperature difference, the better the freshness-keeping performance of the refrigerator. The key component that determines whether the air circulation of the refrigerator is reasonable is an air passage which determines how to transport the air to a reasonable position in the article storage compartment. In air path designs of current air-cooled refrigerators on the market, evaporators in most of the air-cooled refrigerators are arranged in an independent accommodating compartment, and a complicated air passage system is used to connect the accommodating compartment of the evaporator to respective article storage spaces, so that the design of the existing air passage system is relatively complicated and the structure thereof is relatively large. In addition, due to the limitation of the existing air passage system structure, the air cannot be transported to an expected position.

SUMMARY

One object of the present invention is to provide a novel refrigerator to solve one of the above defects of the existing air-cooled refrigerators. The refrigerator comprises a special air passage system that enables the refrigerator to have a reasonable structure design and transport the air effectively.

Especially, the present invention provides a refrigerator, comprising:

a refrigerator body having a cooling space, a first storage space, and a second storage space arranged below the first storage space;

an air duct assembly installed in the refrigerator body with the cooling space located at a rear side of the air duct assembly and the second storage space located at a front side of the air duct assembly, wherein the air duct assembly has an accommodating cavity, a plurality of air passages, and a plurality of air supply ports that face forwards to transport air to the second storage space; and the plurality of air passages comprises a first air passage and a plurality of second air passages; and a branched air supply apparatus installed in the accommodating cavity, wherein the branched air supply apparatus has a peripheral wall portion extending in a longitudinal direction of the refrigerator body; a plurality of air outlets is arranged on the peripheral wall portion; and the plurality of air outlets comprises a first air outlet and a plurality of second air outlets; and wherein the first air passage is configured to connect the first air outlet to the first storage space; and each of the second air passages is configured to connect one of the second air outlets to one or more of the air supply ports, and each of the second air outlets is connected with at least one of the second air passage;

each one of a part of or all of the second air outlets is connected with at least two of the air supply ports, so that airflow flowing out of the second air outlet flows to two transverse sides of a rear portion of the second storage space, the air duct assembly comprises a rear housing portion and a front cover installed at a front side of the rear housing portion; the accommodating cavity and the plurality of air passages are defined by the rear housing portion and the front cover; and the plurality of air supply ports is arranged on the front cover.

Optionally, the rear housing portion comprises a rear housing and at least one air passage bridge arranged in the rear housing; and a front side and a rear side of each air passage bridge are configured to partially or completely define one of the air passages, so that the air passage at the front side of the air passage bridge bypasses the air passage at the rear side of the air passage bridge.

Optionally, the rear housing has a rear wall, an accommodating cavity wall extending forwards from a central portion or an upper portion of the rear wall, a first air passage wall extending backwards from the rear wall, and a second air passage wall extending forwards from the rear wall; there is one air passage bridge, and the air passage bridge is installed on the upper portion of the rear housing, and has a third air passage wall and a fourth air passage wall extending forwards from the third air passage wall; the rear wall, together with the accommodating cavity wall, the air passage bridge and the front cover, defines the accommodating cavity; a rear side of the third air passage wall and the first air passage wall define the first air passage that is connected with the accommodating cavity and extends from the accommodating cavity to an upper rear side of the accommodating cavity; and the rear wall, together with the second air passage wall, the front side of the third air passage wall, the fourth air passage wall and the front cover, defines each of the second air passages.

Optionally, the plurality of second air outlets comprises an air outlet I and an air outlet II; the first air outlet is arranged at an upper side of the peripheral wall portion, and the air outlet I and the air outlet II are arranged on two sides of the first air outlet respectively; the plurality of second air passages comprises an air passage I, an air passage II, an air passage III, and an air passage IV; the air passage I obliquely extends upwards from the air outlet I to a transverse side of the upper portion of the rear housing; after extending upwards from the air outlet I, the air passage II extends to the other transverse side of the upper portion of the rear housing from the air passage bridge over the first air passage, and then extends downwards; the air passage III and the air passage IV both extend downwards from the air outlet II, and a tail end of the air passage III and a tail end of the air passage IV are located at two transverse sides of the lower portion of the rear housing respectively; or a general air passage extends downwards from the air outlet II, and the air passage III and the air passage IV extend from a tail end of the general air passage to two transverse sides of the lower portion of the air duct assembly, respectively.

Optionally, the plurality of air supply ports comprises: a first air supply port, a second air supply port, a third air supply port, and a fourth air supply port that are located at a transverse side of the front cover and arranged at intervals from top to bottom in a vertical direction, and a fifth air supply port, a sixth air supply port, a seventh air supply port, and an eighth air supply port that are located at the other transverse side of the front cover and arranged at intervals from top to bottom in the vertical direction; the air passage I is connected with the first air supply port and the second air supply port; the air passage II is connected with the fifth air supply port and the sixth air supply port; the air passage III is connected with the third air supply port and the fourth air supply port; and the air passage IV is connected with the seventh air supply port and the eighth air supply port.

Optionally, the second storage space comprises an upper tray space, an upper drawer space, a lower tray space, and a lower drawer space sequentially arranged from top to bottom; the first air supply port and the fifth air supply port are connected with the upper tray space; the second air supply port and the sixth air supply port are connected with the upper drawer space; the third air supply port and the seventh air supply port are connected with the lower tray space; and the fourth air supply port and the eighth air supply port are connected with the lower drawer space.

Optionally, an air return passage portion that firstly extends forwards and then extends forwards and downwards is arranged at a lower end of the rear housing portion; the air return passage portion has one or more air return passages; and one or more guiding plates are arranged in a part of the air passages.

Optionally, the branched air supply apparatus further comprises:

a fan configured to cause airflow to enter the peripheral wall portion from the cooling space, and an adjusting portion rotatably arranged in the peripheral wall portion with respect to the peripheral wall portion to completely shield, partially shield or completely expose each of the air outlets at different movement positions, thereby adjusting an air transporting area of each of the plurality of air outlets.

In the refrigerator of the present invention, due to an air duct assembly and a branched air supply apparatus, and due to the special structure and the special position of the air duct assembly, the airflow can enter a plurality of positions of the article storage space conveniently, which particularly facilitates the design of the position to transport the air, thereby allowing the air to be transported to a reasonable position. In addition, each air passage has a relatively short flow path, which can significantly reduce wind resistances, improve smoothness of the air transportation, provide an optimal storage environment for the food, reduce nutrient losses of the food, and decrease power consumption of the refrigerator, thereby saving energy and reducing noise.

Furthermore, in the refrigerator of the present invention, the branched air supply apparatus has an adjusting portion, which can adjust the airflow amount of a part of or all of the air supply ports and thereby adjust the refrigerating amount transported to the article storage space. In this way, on one hand, the structure of the refrigerator can be simplified. For example, structures, such as those of the fan and of a plurality of air doors of the existing air-cooled refrigerators, can be omitted. On the other hand, the air transporting amount to the article storage space can be controlled uniformly, which can reasonably allocate the air transporting amount, and improve the refrigerating effect and freshness-keeping effect of the refrigerator. The design of the fan in the branched air supply apparatus can further enable the refrigerator to have a compact structure, and thereby effectively enlarge the volume of the article storage space. In particular, since the adjustment of air volume in different regions of the freezing compartment of the refrigerator can be achieved, the food can be provided with an optimal storage environment, and nutrient losses of the food can be reduced. In addition, power consumption of the refrigerator can be decreased, and energy can be saved.

DETAILED DESCRIPTION

Figure 1:
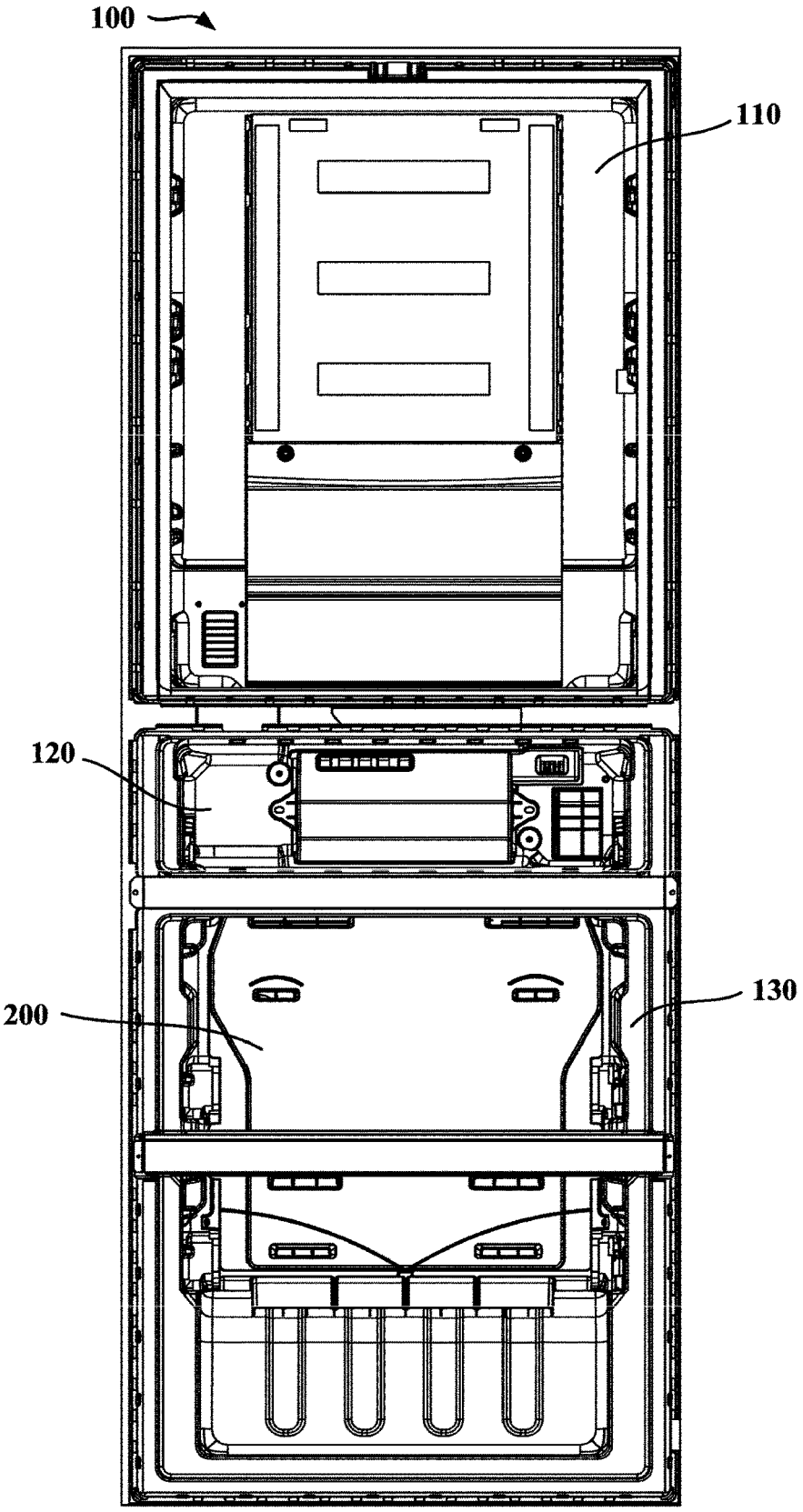
FIG. 1 is a schematic structural view of a refrigerator according to an embodiment of the present invention.

The present invention will be described hereinafter in detail with reference to the specific embodiments shown in the drawings. However, the embodiments do not limit the present invention, and the structures, methods, or functional changes made by those skilled in the art according to the embodiments are all included in the protection scope of the present invention.

FIG. 1 is a schematic structural view of a refrigerator according to an embodiment of the present invention. As shown in FIG. 1, and referring to FIG. 2 and FIG. 3, the present invention provides a refrigerator. The refrigerator may have a refrigerator body 100, a branched air supply apparatus 300, an air duct assembly 200, and a refrigerating system. The refrigerator body may have a cooling space, a first storage space 110, and a second storage space 130 arranged below the first storage space 110. The refrigerating system may be a compression refrigerating system having an evaporator arranged in the cooling space. As known by a person skilled in the art, the refrigerating system may also be other types of refrigerating systems, such as, a semiconductor refrigerating system having a cold end coldness diffuser arranged in the cooling space.

Figure 2:
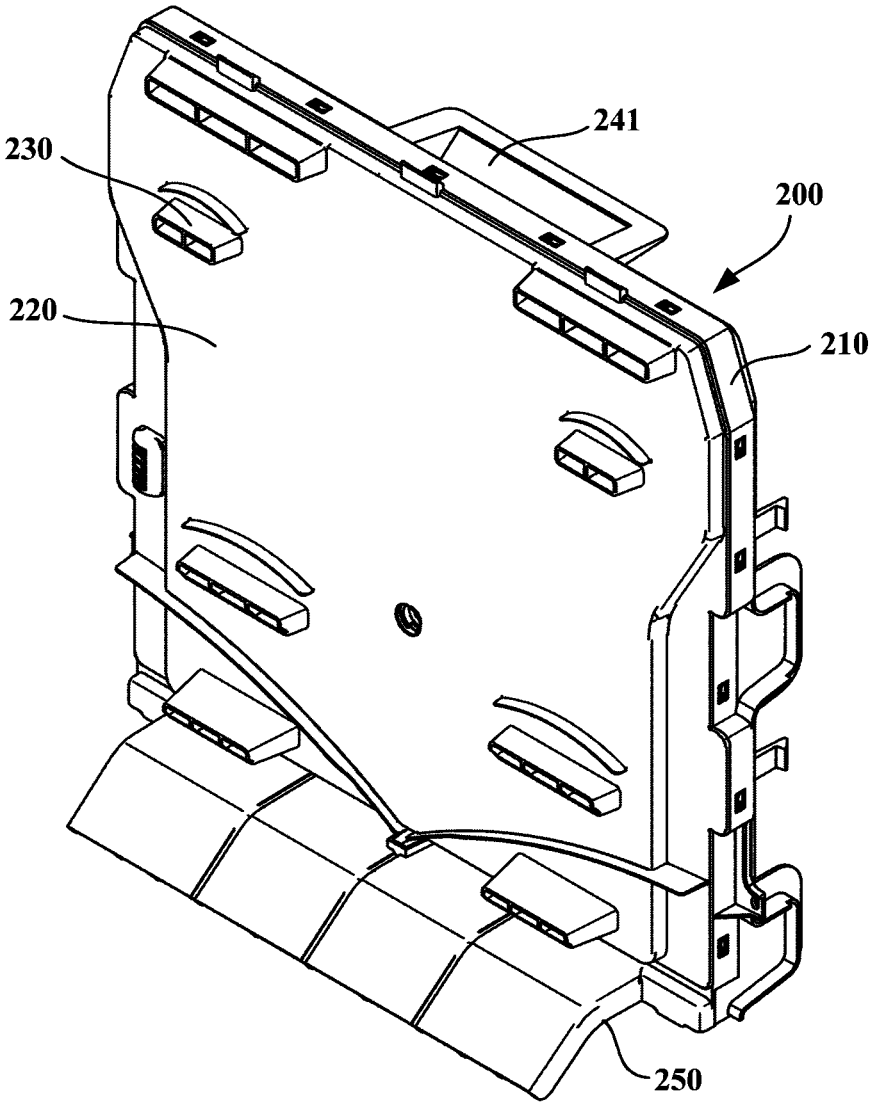
FIG. 2 is a schematic structural view of a branched air supply apparatus installed in an air duct assembly of the refrigerator shown in FIG. 1.
Figure 3:
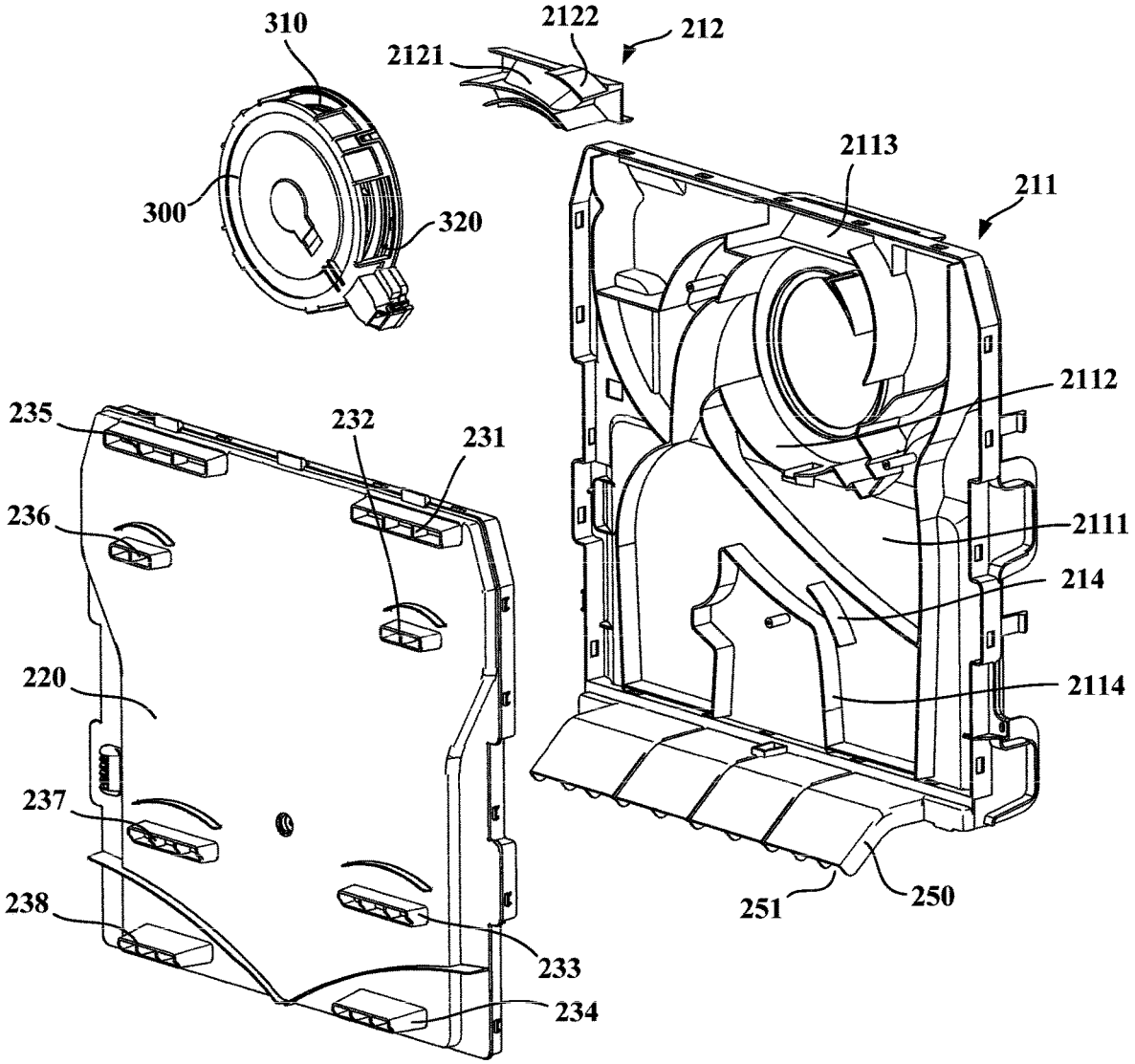
FIG. 3 is a schematic exploded view of the structure shown in FIG. 2.

The air duct assembly 200 may be installed in the refrigerator body 100. The rear side of the air duct assembly 200 is preferably the cooling space, and the front side of the air duct assembly is preferably the second storage space 130. The air duct assembly 200 has an accommodating cavity accommodating the branched air supply apparatus 300, a plurality of air passages, and a plurality of air supply ports 230 that face forwards to transport air to the second storage space 130, as shown in FIG. 2 and FIG. 3. The plurality of air passages comprises a first air passage 241 and a plurality of second air passages.

The branched air supply apparatus 300 is installed in the accommodating cavity of the air duct assembly 200, as shown in FIG. 3. The branched air supply apparatus 300 may have a peripheral wall portion extending in a longitudinal direction of the refrigerator body 100, a first axial end portion arranged at a front end of the peripheral wall portion, and a second axial end portion arranged at a rear end of the peripheral wall portion. The second axial end portion is provided with an air inlet. The peripheral wall portion may extend in a longitude direction of the refrigerator body 100. In other words, the axial direction of the peripheral wall portion extends in the longitudinal direction of the refrigerator body 100. A plurality of air outlets is arranged on the peripheral wall portion. The plurality of air outlets comprises a first air outlet 310 and a plurality of second air outlets 320.

The first air passage 241 is configured to connect the first air outlet 310 to the first storage space 110. Each of the second air passages is configured to connect one of the second air outlets 320 to the one or more air supply ports 230, and each of the second air outlets 320 is connected with at least one second air passage. That is, the airflow flowing out of the cooling space may flow to the first storage space 110 through the first air outlet 310 of the branched air supply apparatus 300 and the first air passage 241. The airflow flowing out of the cooling space may flow to the second storage space 130 through the plurality of second air outlets 320 of the branched air supply apparatus 300 and the plurality of second air passages, and the airflow flowing out through one of the second air outlet 320 may flow to the one or more second air passages. The airflow in each of the second air passages may flow to the second storage space through at least one air supply port 230, so that the second storage space 130 can receive cold air at a plurality of positions in the rear portion thereof.

In some embodiments of the present invention, each one of a part of or all of the second air outlets 320 is connected with at least two air supply ports 230 to allow the airflow flowing out of the second air outlet 320 to flow to two transverse sides of the rear portion of the second storage space 130, so that the airflow can be distributed in the article storage compartment as evenly as possible.

In some embodiments of the present invention, as shown in FIG. 2 and FIG. 3, the air duct assembly 200 may comprise a rear housing 210 and a front cover 220 installed at a front side of the rear housing 210. The accommodating cavity and the plurality of air passages are defined by the rear housing portion 210 and the front cover 220. The plurality of air supply ports 230 is arranged on the front cover 220. The front cover 220 may be engaged with the rear housing portion 210, and may be further fixed by a fixing device such as a screw. The rear housing portion 210 may be engaged with the refrigerator body 100.

In order to facilitate the arrangement of the plurality of air passages, the rear housing portion 210 comprises a rear housing 211 and at least one air passage bridge 212 arranged in the rear housing 211. The front and rear sides of each air passage bridge 212 are both configured to partially or completely define one of the air passages, so that the air passage at the front side of the air passage bridge 212 bypasses the air passage at the rear side of the air passage bridge 212. The rear housing 211 and the air passage bridge 212 may be integrally formed by injection molding, or may be molded separately and then installed. The separate molding may facilitate the installation of the air transporting device 300 or the like.

Figure 4:
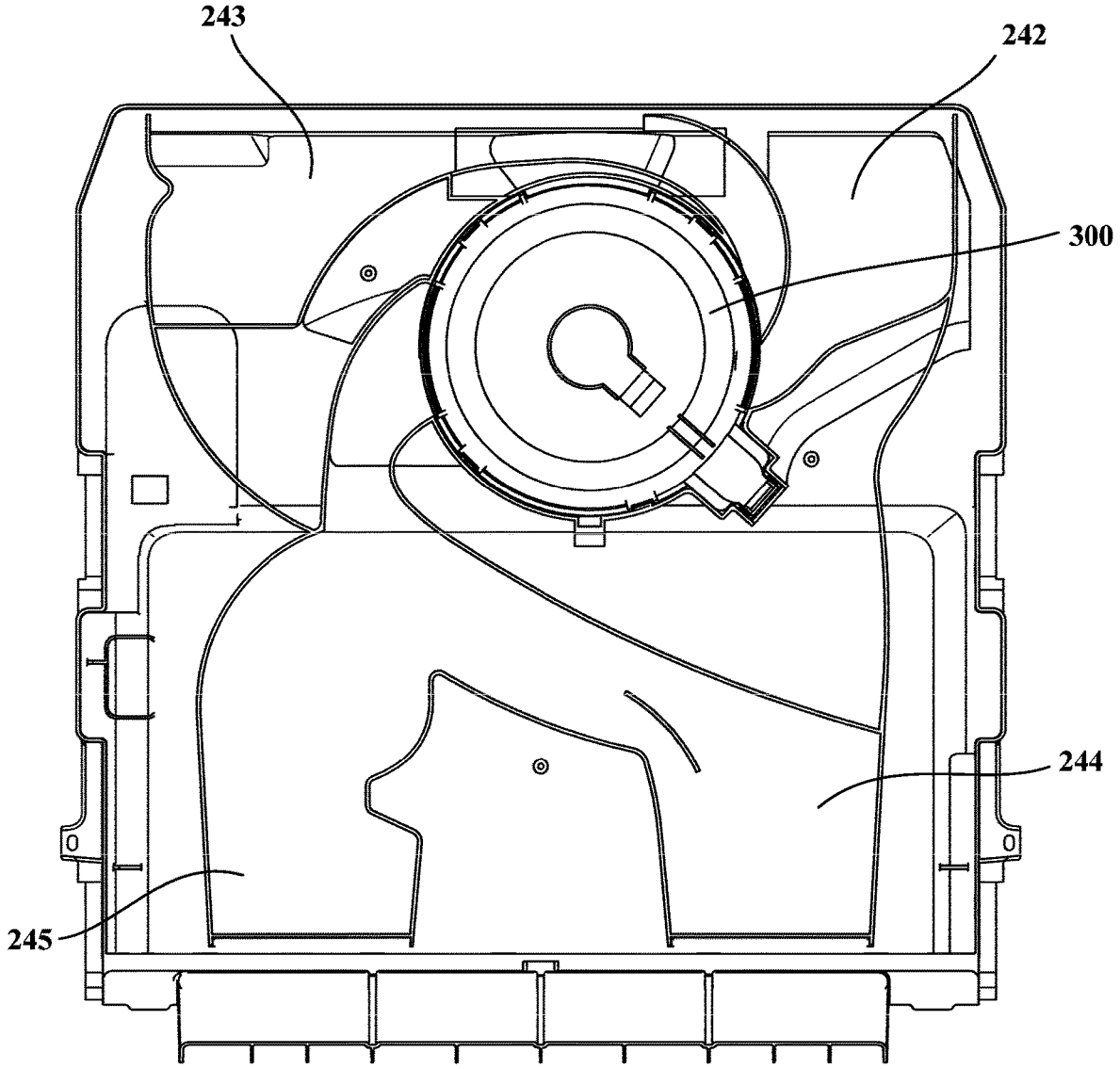
FIG. 4 is a schematic structural view of a branched air supply apparatus installed in a rear housing portion.

In some specific embodiments of the present invention, as shown in FIG. 3 and FIG. 4, the rear housing 211 has a rear wall 2111, an accommodating cavity wall 2112 extending forwards from a central portion or an upper portion of the rear wall 2111, a first air passage wall 2113 extending backwards from the rear wall 2111, and a second air passage wall 2114 extending forwards from the rear wall 2111. There is one air passage bridge 212. The air passage bridge 212 is installed on the upper portion of the rear housing 211, and has a third air passage wall 2121 and a fourth air passage wall 2122 extending forwards from the third air passage wall 2121. The rear wall 2111, together with the accommodating cavity wall 2112, the air passage bridge 212 and the front cover 220, defines the accommodating cavity. The rear side of the third air passage wall 2121 and the first air passage wall 2113 define the first air passage 241 that is connected with the accommodating cavity and extends from the accommodating cavity to the rear upper side of the accommodating cavity. The rear wall 2111, together with the second air passage wall 2114, the front side of the third air passage wall 2121, the fourth air passage wall 2122 and the front cover 220, defines each of the second air passages.

In some further embodiments of the present invention, the plurality of second air outlets 320 comprises an air outlet I and an air outlet II. The first air outlet 310 is arranged at the upper side of the peripheral wall portion, and the air outlet I and the air outlet II are arranged at two sides of the first air outlet 310 respectively. The plurality of second air passages comprises an air passage I 242, an air passage II 243, an air passage III 244, and an air passage IV 245. The air passage I 242 obliquely extends upwards from the air outlet I to a transverse side of the upper portion of the rear housing 211. After extending upwards from the air outlet I, the air passage II 243 extends to the other transverse side of the upper portion of the rear housing 211 from the air passage bridge 212 over the first air passage 241, and then extends downwards. The air passage III 244 and the air passage IV 245 both extend downwards from the air outlet II, and a tail end of the air passage III 244 and a tail end of the air passage IV 245 are located at two transverse sides of the lower portion of the rear housing 211 respectively. Or, a general air passage may extend downwards from the air outlet II, and the air passage III 244 and the air passage IV 245 extend from a tail end of the general air passage to two transverse sides of the lower portion of the air duct assembly 200, respectively. In some alternative embodiments, the air passage II 243 extends from an upper end of the air passage I 242. That is, the air passage II 243 and the air passage I 242 actually form one second air passage.

In some embodiments of the present invention, the first storage space 110 may be a refrigerating space, and the second storage space 130 may be a freezing space. Preferably, the second storage space 130 may also be divided into four layers of spaces sequentially arrange from top to bottom. In some optional embodiments, the four layers of spaces that are sequentially arranged from top to bottom may be an upper tray space, an upper drawer space, a lower tray space, and a lower drawer space. A tray may be installed in each of the upper tray space and the lower tray space; and a drawer may be installed in each of the upper drawer space and the lower drawer space. Furthermore, a temperature changing space 120 may be arranged between the refrigerating space and the freezing space, and they may be spaced from each other by a partition plate; and a partition plate is also arranged between the upper drawer space and the lower tray space. In some alternative embodiments, the four layers of spaces that are sequentially arranged from top to bottom may be partitioned merely by partition plates.

The plurality of air supply ports 230 comprises: a first air supply port 231, a second air supply port 232, a third air supply port 233, and a fourth air supply port 234 that are located at a transverse side of the front cover and arranged at intervals from top to bottom in a vertical direction, and a fifth air supply port 235, a sixth air supply port 236, a seventh air supply port 237, and an eighth air supply port 238 that are located at the other transverse side of the front cover and arranged at intervals from top to bottom in the vertical direction. The air passage I 242 is connected with the first air supply port 231 and the second air supply port 232; the air passage II 243 is connected with the fifth air supply port 235 and the sixth air supply port 236; the air passage III 244 is connected with the third air supply port 233 and the fourth air supply port 234; and the air passage IV 245 is connected with the seventh air supply port 237 and the eighth air supply port 238. In addition, the first air supply port 231 and the fifth air supply port 235 are connected with the upper tray space; the second air supply port 232 and the sixth air supply port 236 are connected with the upper drawer space; the third air supply port 233 and the seventh air supply port 237 are connected with the lower tray space; and the fourth air supply port 234 and the eighth air supply port 238 are connected with the lower drawer space.

In the refrigerator of the embodiment of the present invention, due to the design of the structure and the installation position of the air duct assembly 200, the cold air can be transported to different compartments of the refrigerator through different air paths. Furthermore, by cooperatively using the branched air supply apparatus 300, the refrigerating space and the freezing space can be controlled separately, so that the temperature of each layer of the freezing space can be adjusted in real time, thereby improving the freezing and freshness-keeping performance of the refrigerator, preventing the food from losing nutrient, reducing power consumption, and saving energy.

In some further embodiments of the present invention, each of the air supply ports 230 may be a stripe-shaped air supply port extending longitudinally in a horizontal direction. A partition plate is also arranged in each of the air supply ports 230, so that the air supply ports 230 are a plurality of small air transporting holes. One or more guiding plates 214 are arranged in a part of the air passages. Furthermore, an air return passage portion 250 that firstly extends forwards and then extends forwards and downwards is arranged at the lower end of the rear housing portion 210 to fit the compressor compartment at a lower portion of the refrigerator body 100. The air return passage portion 250 has one or more air return passages 251.

In some embodiments of the present invention, the rear wall 2111 of the rear housing 211 may comprise a lower-middle wall portion, an upper wall portion, and a connecting wall portion. The lower-middle wall portion is located at a front side of the upper wall portion, and the connecting wall portion connects an upper end of the lower-middle wall portion and a lower end of the upper wall portion. This arrangement may provide a relatively large space for placing the evaporator or the like, and also facilitate the installation of the branched air supply apparatus 300. Thus, the design is particularly reasonable. In some alternative embodiments of the present invention, the rear wall 2111 of the rear housing 211 may comprise a lower-middle wall portion and an upper wall portion. The upper end of the lower-middle wall portion is connected with the lower end of the upper wall portion. The rear surface of the lower-middle wall portion may be recessed forwards to provide a space for placing the evaporator.

In some embodiments of the present invention, the branched air supply apparatus 300 may further comprise a fan configured to cause the airflow to enter the peripheral wall portion 310 from the cooling space by passing through the air inlet. The fan is preferably a centrifugal fan. The design of the fan in the branched air supply apparatus 300 can further enable the refrigerator to have a compact structure, and thereby effectively enlarge the volume of the article storage space. In some preferred embodiments of the present invention, the branched air supply apparatus 300 may further comprise an adjusting portion that is rotatably arranged in the peripheral wall portion with respect to the peripheral wall portion to completely shield, partially shield or completely expose each of the air outlets at different movement positions, thereby adjusting an air transporting area of each of the plurality of air outlets. The arrangement of the adjusting portion allows uniform control of the air transporting amount to the article storage space, which can reasonably allocate the air transporting amount, and improve the refrigerating effect and freshness-keeping effect of the refrigerator.

In some embodiments of the present invention, the peripheral wall portion preferably has a cylindrical shape, and may be integrally formed with one of the first axial end portion and the second axial end portion, with the other thereof being engaged with the peripheral wall portion. The integrated structure of the peripheral wall portion, the first axial end portion, and the second axial end portion may also be referred to as a housing of the branched air supply apparatus 300.

In some embodiments of the present invention, the adjusting portion may comprise one or more shielding portions arranged at intervals in a circumferential direction of the first axial end portion, and at least one circulating portion. The shielding portions and the circulating portions are sequentially arranged in the circumferential direction of the first axial end portion, and the one or more shielding portions and the at least one circulating portion enclose a cylindrical structure. In addition, the adjusting portion is arranged at an inner side of the peripheral wall portion, and can be rotated to different rotating positions to enable the one or more shielding portions to completely shield, partially shield or completely expose each of the air outlets, so that the airflow can enter the partially shielded or completely exposed air outlets through the at least one circulating portion.

Specifically, the shielding portion may be a shielding sheet, and intervals, notches or holes between every two adjacent shielding sheets may be the circulating portions. In particular, when there is only one shielding portion, there is also only one corresponding circulating portion. For example, the adjusting portion may comprise a base portion and a shielding sheet arranged on the base portion. In another example, the adjusting portion may comprise a cylindrical member, and the cylindrical member is provided with a plurality of circulating portions. The base portion may be arranged on both ends of the cylindrical member to enhance the strength. Furthermore, optionally, the base portion may be rotatably installed to the first axial end portion or the second axial end portion. For example, an annular groove is arranged at an inner surface of the first axial end portion or the second axial end portion, and an annular protrusion corresponding to the annular groove may be arranged on the base portion to insert into the annular groove for rotation. Further optionally, the base portion may be rotatably installed to an end of the peripheral wall portion. When the peripheral wall portion is integrally formed with the first axial end portion, the base portion is rotatably installed to an end of the peripheral wall portion near the second axial end portion.

In some embodiments of the present invention, the branched air supply apparatus 300 may also comprise a motor and a transmission mechanism. The motor may be arranged at an outer side of the peripheral wall portion in a radial direction. The transmission mechanism is configured to transmit the rotational motion output by the motor to the adjusting portion. For example, the transmission mechanism may preferably be a gear transmission mechanism. A gear ring is arranged on the base portion of the adjusting portion (the gear ring may be integrally formed with the base portion), and an output end of the motor may be equipped with a gear. The gear meshes with the gear ring, so that the motor can drive the gear ring to rotate, thereby driving the adjusting portion to rotate. Furthermore, a motor accommodating portion may be arranged at an outer side of the peripheral wall portion for accommodating the motor.

In some specific embodiments of the present invention, the air outlet I, the first air outlet 310 and the air outlet II are sequentially arranged at intervals in the circumferential direction of the first axial end portion and in the counterclockwise direction (taking the sight line of the observer viewing from the first axial end portion to the second axial end portion as a reference, that is, taking a sight line in a front-rear direction as a reference). In addition, the distance between the air outlet I and the other two air outlets may both be the length of one air outlet. In the adjusting portion, the number of the shielding portions and the circulating portions is three. The three shielding portions are a first shielding portion, a second shielding portion, and a third shielding portion, respectively. The three circulating portions are a first circulating portion, a second circulating portion, and a third circulating portion, respectively. The shielding portions and the circulating portions are sequentially arranged at intervals in the circumferential direction of the first axial end portion and in the counterclockwise direction. The first shielding portion and the second shielding portion are both configured to completely shield a region of one air outlet. The third shielding portion is configured to at least completely shield a region of two air outlets. For example, the third shielding portion may shield a region of two air outlets. The circulating portion between the first shielding portion and the second shielding portion is the first circulating portion that is configured to completely expose the region of one air outlet. The circulating portion between the second shielding portion and the third shielding portion is the second circulating portion that is configured to completely expose the region of one air outlet. The circulating portion between the third shielding portion and the first shielding portion is the third circulating portion. During operation, the adjusting portion may be rotated to cause different air outlets at an open state. For example, when the first shielding portion shields the first air outlet 310, the air outlet I and the air outlet II may both be at an open state. In another example, when the second shielding portion shields the first air outlet 310, the air outlet I and the air outlet II may both be at a closed state.

In some alternative embodiments of the present invention, the distance between the first air outlet 310 and other two air outlets may both be 1/7 to 1/10 of the length of one air outlet. In the adjusting portion, the number of the shielding portions and the circulating portions is two respectively. The two shielding portions are a first shielding portion and a second shielding portion, respectively. The two circulating portions are a first circulating portion and a second circulating portion, respectively. The shielding portions and the circulating portions are sequentially arranged at intervals in the circumferential direction of the first axial end portion and in the clockwise direction. The first shielding portion is configured to completely shield one air outlet. The second shielding portion is configured to at least completely shield two air outlets. For example, the second shielding portion may shield three air outlets and a connecting segment of the peripheral wall portion between every two air outlets. The first circulating portion is configured to completely expose one air outlet. The second circulating portion is configured to completely expose three air outlets. During operation, the adjusting portion may be rotated to cause different air outlets at an open state. For example, when the first shielding portion shields the first air outlet 310, the air outlet I and the air outlet II may both be at an open state. In another example, when the first circulating portion is communicated with the first air outlet 310, the air outlet I and the air outlet II may both be at a closed state. In some embodiments of the present invention, any two of the plurality of air outlets may have the same size or different sizes.

The detailed descriptions set forth above are merely illustrative of the possible embodiments of the present invention, and are not intended to limit the protection scope of the present invention. Equivalent embodiments or modifications that do not depart from the spirit of the invention are intended to be included in the protection scope of the present invention.

What is claimed is:

1. A refrigerator, comprising:

a refrigerator body having a cooling space, a first storage space, and a second storage space arranged below the first storage space;

an air duct assembly installed in the refrigerator body with the cooling space located at a rear side of the air duct assembly and the second storage space located at a front side of the air duct assembly, wherein the air duct assembly has an accommodating cavity, a plurality of air passages, and a plurality of air supply ports that face forwards to transport air to the second storage space; and the plurality of air passages comprises a first air passage and a plurality of second air passages; and a branched air supply apparatus installed in the accommodating cavity, wherein the branched air supply apparatus has a peripheral wall portion extending in a longitudinal direction of the refrigerator body; a plurality of air outlets is arranged on the peripheral wall portion; and the plurality of air outlets comprises a first air outlet and a plurality of second air outlets; and wherein the first air passage is configured to connect the first air outlet to the first storage space;

each of the second air passages is configured to connect one of the second air outlets to one or more of the air supply ports, and each of the second air outlets is connected with at least one of the second air passage; and each one of a part of or all of the second air outlets is connected with at least two of the air supply ports, so that airflow flowing out of the second air outlet flows to two transverse sides of a rear portion of the second storage space, the air duct assembly comprises a rear housing portion and a front cover installed at a front side of the rear housing portion; the accommodating cavity and the plurality of air passages are defined by the rear housing portion and the front cover; and the plurality of air supply ports is arranged on the front cover.

2. The refrigerator according to claim 1, wherein the rear housing portion comprises a rear housing and at least one air passage bridge arranged in the rear housing; and a front side and a rear side of each air passage bridge are configured to partially or completely define one of the air passages, so that the air passage at the front side of the air passage bridge bypasses the air passage at the rear side of the air passage bridge.

3. The refrigerator according to claim 2, wherein the rear housing has a rear wall, an accommodating cavity wall extending forwards from a central portion or an upper portion of the rear wall, a first air passage wall extending backwards from the rear wall, and a second air passage wall extending forwards from the rear wall; there is one air passage bridge, and the air passage bridge is installed on the upper portion of the rear housing, and has a third air passage wall and a fourth air passage wall extending forwards from the third air passage wall; the rear wall, together with the accommodating cavity wall, the air passage bridge and the front cover, defines the accommodating cavity; a rear side of the third air passage wall and the first air passage wall define the first air passage that is connected with the accommodating cavity and extends from the accommodating cavity to an upper rear side of the accommodating cavity; and the rear wall, together with the second air passage wall, the front side of the third air passage wall, the fourth air passage wall and the front cover, defines each of the second air passages.

4. The refrigerator according to claim 3, wherein the plurality of second air outlets comprises an air outlet I and an air outlet II; the first air outlet is arranged at an upper side of the peripheral wall portion, and the air outlet I and the air outlet II are arranged on two sides of the first air outlet respectively; the plurality of second air passages comprises an air passage I, an air passage II, an air passage III, and an air passage IV; the air passage I obliquely extends upwards from the air outlet I to a transverse side of the upper portion of the rear housing; after extending upwards from the air outlet I, the air passage II extends to the other transverse side of the upper portion of the rear housing from the air passage bridge over the first air passage, and then extends downwards; the air passage III and the air passage IV both extend downwards from the air outlet II, and a tail end of the air passage III and a tail end of the air passage IV are located at two transverse sides of the lower portion of the rear housing respectively; or a general air passage extends downwards from the air outlet II, and the air passage III and the air passage IV extend from a tail end of the general air passage to two transverse sides of the lower portion of the air duct assembly, respectively.

5. The refrigerator according to claim 4, wherein the plurality of air supply ports comprises: a first air supply port, a second air supply port, a third air supply port, and a fourth air supply port that are located at a transverse side of the front cover and arranged at intervals from top to bottom in a vertical direction, and a fifth air supply port, a sixth air supply port, a seventh air supply port, and an eighth air supply port that are located at the other transverse side of the front cover and arranged at intervals from top to bottom in the vertical direction; the air passage I is connected with the first air supply port and the second air supply port; the air passage II is connected with the fifth air supply port and the sixth air supply port; the air passage III is connected with the third air supply port and the fourth air supply port; and the air passage IV is connected with the seventh air supply port and the eighth air supply port.

6. The refrigerator according to claim 5, wherein the second storage space comprises an upper tray space, an upper drawer space, a lower tray space, and a lower drawer space sequentially arranged from top to bottom; the first air supply port and the fifth air supply port are connected with the upper tray space; the second air supply port and the sixth air supply port are connected with the upper drawer space; the third air supply port and the seventh air supply port are connected with the lower tray space; and the fourth air supply port and the eighth air supply port are connected with the lower drawer space.

7. The refrigerator according to claim 1, wherein an air return passage portion that firstly extends forwards and then extends forwards and downwards is arranged at a lower end of the rear housing portion; the air return passage portion has one or more air return passages; and one or more guiding plates are arranged in a part of the air passages.

8. The refrigerator according to claim 1, wherein the branched air supply apparatus further comprises:

a fan configured to cause airflow to enter the peripheral wall portion from the cooling space; and an adjusting portion rotatably arranged in the peripheral wall portion with respect to the peripheral wall portion to completely shield, partially shield or completely expose each of the air outlets at different movement positions, thereby adjusting an air transporting area of each of the plurality of air outlets.

* * * * *